United States Patent [19]

Weisner et al.

[11] Patent Number: 4,848,051

[45] Date of Patent: Jul. 18, 1989

[54] GLASS GLAZED STANDING SEAM SKYLIGHT

[75] Inventors: Kent A. Weisner, Maitland; Lester L. Walls, Jr., Deltona, both of Fla.

[73] Assignee: Henergy Enterprises Limited Partnership, Wassau, Wis.

[21] Appl. No.: 184,201

[22] Filed: Apr. 21, 1988

[51] Int. Cl.[4] ..... E04B 7/18

[52] U.S. Cl. ..... 52/200; 52/213

[58] Field of Search ..... 52/200, 204, 211, 213

[56] References Cited

U.S. PATENT DOCUMENTS

| | | | |
|---|---|---|---|
| 4,559,753 | 12/1985 | Brueske | 52/200 X |
| 4,577,619 | 3/1986 | Howe, Jr. | 52/200 X |
| 4,649,680 | 3/1987 | Weisner et al. | 52/200 |
| 4,693,043 | 9/1987 | Knapp | 52/211 |

FOREIGN PATENT DOCUMENTS

| | | | |
|---|---|---|---|
| 2045844 | 11/1980 | United Kingdom | 52/200 |

*Primary Examiner*—Carl D. Friedman

*Attorney, Agent, or Firm*—Macdonald J. Wiggins

[57] ABSTRACT

A low profile glass skylight for a sloping roof has a unitary rectangular frame having an upstanding standing seam element along each longitudinal edge and head and sill flashings. Webs depending from the frame form an insert for a glass pane. A rectangular wood frame disposed in the insert maintains the glass pane in place. The skylight is installed in a sloping shingled roof with the sill flashing overlapping shingles and shingles overlapping the head flashing. Cleats attached to the roof sheathing engage the standing seam element and a plurality of step flashings adjacent the standing seams and interleaved with shingles. A weather cap is installed over the standing seams.

27 Claims, 4 Drawing Sheets

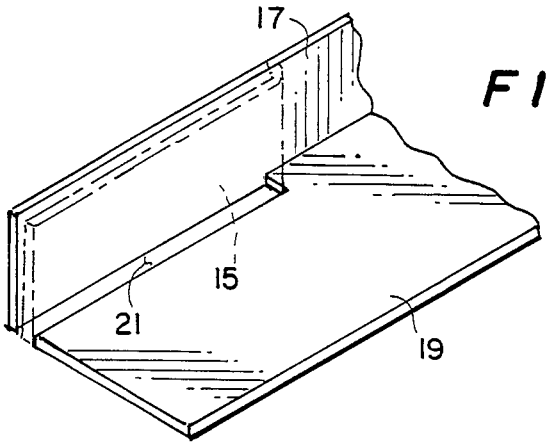
FIG. 5
FIG. 6
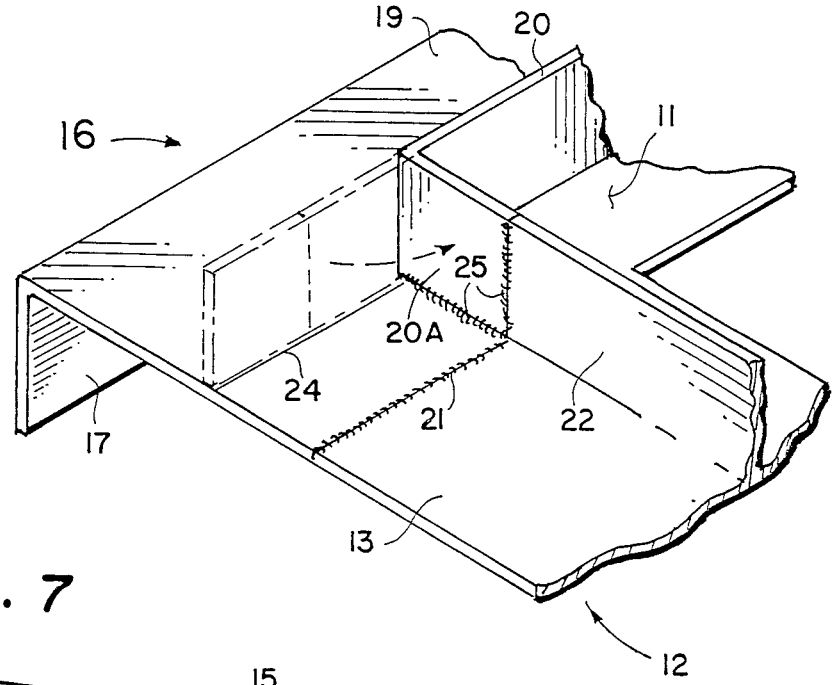
FIG. 7
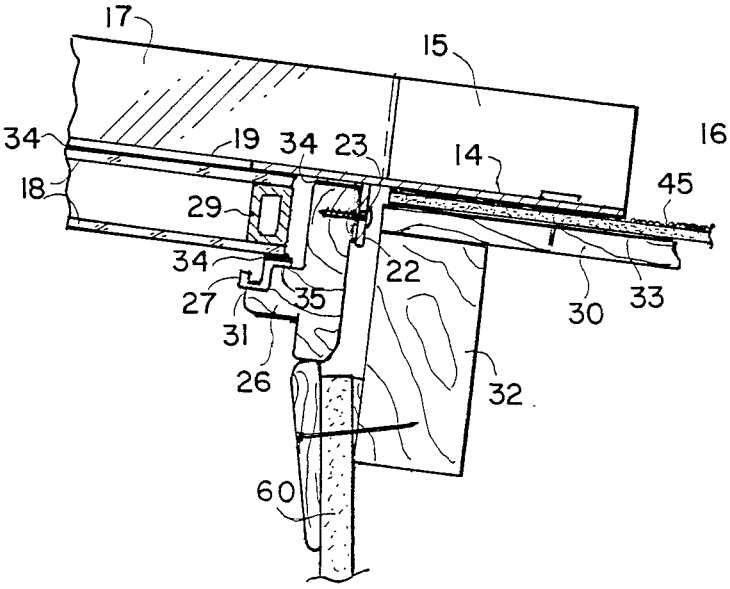

GLASS GLAZED STANDING SEAM SKYLIGHT

BACKGROUND OF THE INVENTION

1. Field of the Invention

The present invention relates to skylights, and more particularly to a glass skylight having standing seam longitudinal elements which permit a leakproof installation in a sloping shingle roof without the use of a curb.

2. Description of the Prior Art

The use of glass for skylights is very popular due to the excellent light transmission characteristics and clarity of glass. However, problems have always existed in mounting glass panes in roof structures due to the difficulty in sealing against water leakage. The result is that leakproof mounting structures have been quite expensive and complex. The most common method of mounting glass type skylights in roofs is to construct a curb which extends above the plane of a roof and to attach the skylight assembly to the top of the curb. This procedure places the seam or interface between the skylight structure and the roof well above the plane of the roof such that water draining down the roof does not come in contact with the seam. Although such curb structures are generally suitable, the additional construction for the curb adds greatly to the cost of a skylight installation and, for many buildings, such as residential structures, curb mountings are unsightly.

Examples of prior art glass skylight structures include U.S. Pat. No. 4,468,899 to Miller which shows a glass skylight having an extruded aluminum frame forming a curb in which the glass portions are supported within the extruded aluminum curb. A low profile skylight is taught in the Jankowski U.S. Pat. No. 4,193,237. In this structure, asphalt shingles are curled upward and attached to a frame along the edges of the curb. Another low profile skylight is taught by Helma, U.S. Pat. No. 3,440,779, which discloses an extruded curb as does Gildehouse in U.S. Pat. No. 2,425,060.

There is a need for a glass pane skylight which can be mounted with the glass essentially in the plane of a roof without the use of a curb and which will be essentially leakproof.

SUMMARY OF THE INVENTION

The present invention is related to U.S. Pat. No. 4,649,680 and patent applications Ser. Nos. 917,846 and 920,254. The invention is directed to a flat glass glazed skylight having a frame with longitudinal edges thereof upturned to mate with step flashings when installed in a sloping roof thereby forming a standing seam above the plane of the roof. Therefore, the flat glass therefore mounts essentially flush with the roof decking.

The skylight utilizes a unitary rectangular roof mounting frame which is preferably formed from extruded aluminum or other suitable material such as a high impact plastic. A first aluminum extrusion forms the longitudinal sides of the frame and includes a horizontal portion having an upstanding longitudinal edge thereof and a dependent web projecting downward from the underside of the horizontal portion. A second extrusion is utilized for the head and sill lateral portions of the frame and which has a flat horizontal portion and a depending web matching the depending web of the first extrusion. Sections of the extrusions are cut and assembled together as by welding to form a rectangular skylight frame having a rectangular opening for a pane of glass. The longitudinal and lateral depending webs together form a narrow rectangular recess into which the flat glass pane is inserted. A rectangular retainer frame is provided having rabbeted areas to form a shelf for supporting the glazing. The retainer frame fits within the rectangular recess formed by the webs and is attached to the webs by screws or staples with the glass captivated between the rabbeted shelf and the extruded frame. Sealing compound, such as silicone or urethane, is used around the edges of the glass pane as is common practice for glazed structures. The retainer frame may be formed from wood, plastic or other suitable material.

A skylight unit in accordance with the invention may be installed in a roof deck rough opening after application of roofing felt and shingling up to the lower edge of the roof opening. The skylight frame is placed in the opening with the upstanding longitudinal standing seam edges in the direction of the slope of the roof. Fastening cleats are disposed along the standing seam outerface and nailed to the roof decking with a first tab of each cleat bent over the top edge of the standing seam portion of the frame. The lateral head portion of the frame is attached to the roof decking over the felt while the lateral sill portion of the frame is attached over the row of roofing adjacent the lower roof decking cutout edge. The roof is then shingled along the upstanding longitudinal faces of the frame, with step flashing and sealant installed overlapping and underlaying the shingles in conventional fashion. As each step flashing is installed, the vertical portion thereof mates with and matches the vertical standing seam face of the skylight. A second tab on the fastening cleat is folded over the vertical portion of the step flashing for securing the standing seam portion to the step flashing. After shingling is complete, a continuous sealant-filled weather cap is installed over the standing seams formed by the upturned longitudinal edges of the skylight frame and the step flashings. The weather cap snaps over the folded-down cleat tabs. A sealant-filled flashing shroud is also utilized over the end of each weather cap at the head thereof.

As will now be recognized, the overlapping step flashings interleaved with the shingles along the longitudinal edges prevent water intrusion at the point where the frame contacts the roofing felt and sheathing, and raises the actual seam above the plane of the roof along the upper edges of the standing seams. Thus, a skylight may be made leakproof without the necessity of expensive curbing while still providing a very low profile skylight. Further, the skylight assembly may be very economically produced since it utilizes a minimum of material. The skylight frame, which is preferably extruded from aluminum, is lightweight, sturdy, and low cost and requires only a low cost wooden retainer frame to support the glazing within the frame. The remainder of the installation uses readily available material such as low cost metal flashing, and plastic weather caps and shrouds.

It is therefore a principal object of the invention to provide a glass glazed skylight which can be installed with the glass essentially in the plane of a sloping roof and in which the longitudinal joints are raised above the plane of a roof by means of a standing seam.

It is another object of the invention to provide a standing seam glass skylight, for use in sloping roofs which utilizes low cost extrusions, and which can be quickly and easily installed.

It is still another object of the invention to provide a standing seam type glass skylight having a very low profile and which utilizes longitudinal standing seams including step flashing when utilized in a shingle roof.

It is yet another object of the invention to provide a glass skylight that does not require a curb and curb flashing for installation on sloping roofs.

It is another object of the invention to provide a glass skylight having integral head and sill flashing, thereby eliminating separate flashing required by prior art glass skylights.

These and other objects and advantages of the invention will become apparent from the following detailed description when read in conjunction with the drawings.

BRIEF DESCRIPTION OF THE DRAWINGS

FIG. 5 is a partial view of the longitudinal portion of the frame of FIG. 1 showing a construction permitting skylights of the invention to nest with each other vertically and side by side;

FIG. 6 is a view of a corner of the skylight frame of FIG. 1 inverted showing the method of construction thereof;

FIG. 7 is a longitudinal cross-sectional view of the sill end of the skylight of FIG. 4 when installed in a sloping roof;

DETAILED DESCRIPTION OF THE PREFERRED EMBODIMENT

Figure 1:
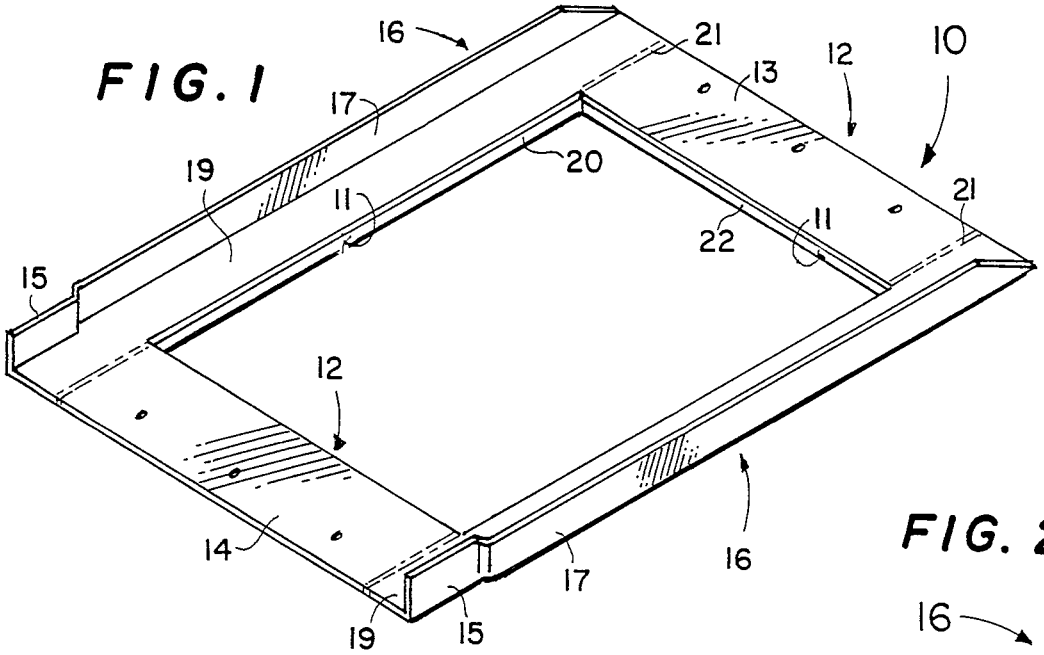
FIG. 1 is a perspective view of the top surface of a skylight frame for a glass skylight in accordance with the invention.
Figure 2:
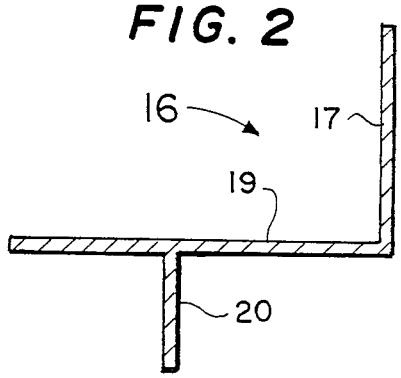
FIG. 2 is a cross sectional view of the extrusion member used to form the longitudinal portions of the frame of the skylight of FIG. 1.
Figure 3:
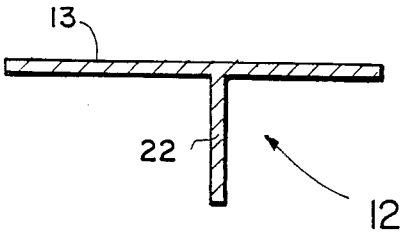
FIG. 3 is a cross-sectional view of the extrusion member used to form the lateral portions of the skylight frame of FIG. 1.
Figure 4:
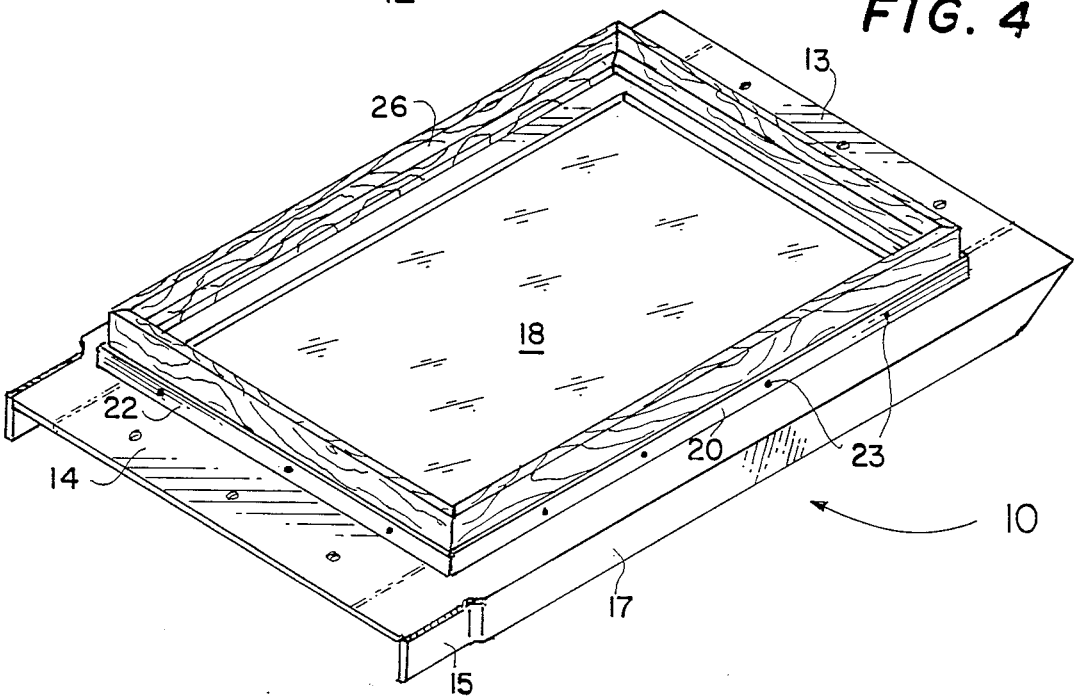
FIG. 4 is a perspective view of the skylight of the invention inverted to show the glass-supporting retainer frame thereof.

The standing seam skylight of the invention utilizes a skylight mounting frame 10 shown in FIG. 1 which is combined with a flat glass pane 18, and a pane retaining frame 26 as shown in FIG. 4. Frame 10 is preferably formed from extruded aluminum or the like; however, rigid plastic or other types of metal may be used. Retainer frame 26 may be formed from wood, plastic or metal although wood is preferred. Mounting frame 10 is formed from two extrusions, a longitudinal extrusion 16 shown in cross-section in FIG. 2 and a lateral extrusion 12 shown in cross-section in FIG. 3. The thickness of the extrusions may be in the range of 0.06–0.1 inches for an aluminum extrusion. The longitudinal frame elements 16 each have a horizontal flashing portion 19 and a vertical standing seam element 17 formed along a longitudinal edge of flashing 19. Standing seam element 17 may have a height of about 1.5 inches but is not to be limited to this dimension. Depending from horizontal flashing 19 is a web 20 having a vertical dimension dependent on the thickness of glass to be used with the skylight. In one embodiment of the invention utilizing a double pane, the vertical dimension of web 20 may be on the order of $\frac{3}{4}$ inch. The lateral flashings 13 and 14 of frame 10 each have a dependent web 22 having the same vertical dimension as web 20. Lateral flashing 13 is utilized as an integral head flashing for the skylight and flashing 14 serves as an integral sill flashing. Flashings 19, 13, and 14 are welded together as indicated by weld lines 21 to form skylight mounting frame 10 and a glass receiving recess 11.

Standing seam elements 17 at the sill flashing end are offset as indicated at 15 when it is desired to vertically gang two or more of the frames 10. To form the offsets 15 when using metal extrusions, the procedure illustrated in FIG. 5 may be used. A cut 21 is made between horizontal flashing 19 and standing seam element 17. The cut free end of standing seam element 17 is bent as shown by the dashed lines and welded to horizontal flashing 19.

Referring to FIG. 4, frame 10 is shown in an inverted position with glass pane 18 and retainer frame 26 installed therein. As will be noted, webs 20 and 22 form a recess 11 with details thereof shown in FIG. 6. Web 20 of extrusion 16 is cut along line 24 and bent at 90° as shown by the arrow. The bent portion 20A is trimmed to mate with web 22 of extrusion 12. Bent portion 20A may be welded along lines 25 as shown and the other three corners similarly fabricated to provide the recess 11 for flat glass pane 18. Glass retainer frame 26, which may preferably be formed from wood or plastic, is secured to webs 20 and 22 by screws 23 through openings in webs 20 and 22.

Figure 8:
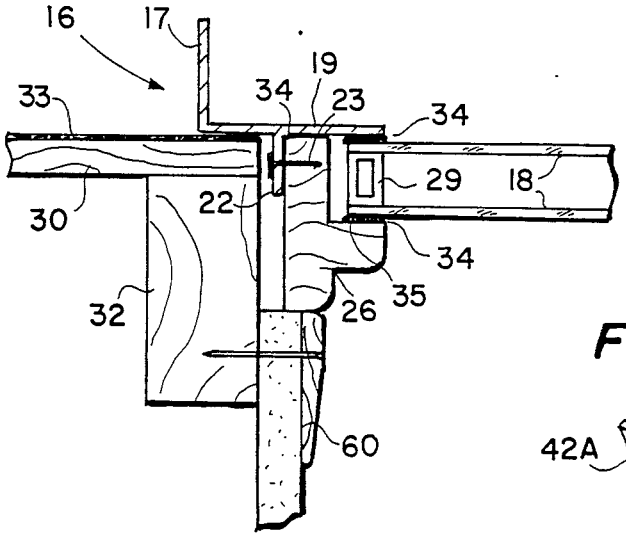
FIG. 8 is a lateral cross-sectional view of the skylight of FIG. 4 installed in a roof.

Details of the assembly of glass pane 18 and retainer frame 26 are shown in FIGS. 7 and 8. In FIG. 7, a longitudinal cross section of the sill portion of a skylight which is being installed in a roof opening is shown. Sill flashing 14 is fastened to roof sheathing 30 which is, at this point, covered with roofing felt 33 and shingled to the bottom of the roof opening with shingles 45. Thus, sill flashing 14 overlaps shingles 45 and felt 33. Retainer frame 26, shown in cross sectional view, is provided with a shelf 35 for supporting the edges of the glazing material. In this example, double panes 18, separated by a spacer 29, are used. Preferably, thermal glass using hermetically sealed and spaced panes of tempered glass is used for thermal insulation purposes. However, any commercially available glass panes may be used. A sealant 34, such as silicone urethane, is utilized between the lower surfaces of horizontal flashings 19, 13, and 14 and other areas where the glass contacts supporting material. A series of holes is provided in webs 20 and 22 to permit use of screws 23 for attachment of web 22 to glass retaining frame 26. Along the sill end of retainer frame 26, an additional rabbet 31 is provided for installation of an extruded V-shaped condensation collector 27. When glass 18 is of the insulating type having a high R-factor, no drain has been found to be required.

In FIG. 8, a lateral cross-section of the installation of FIG. 7 is shown. The longitudinal and head elements of frame 26 have a single rabbet since condensation collector 27 is only required only at the sill end thereof. Gypsum board and molding 40 or other interior treatment may be attached to rafters or purlins 32 as shown in FIGS. 7 and 8.

Figure 10:
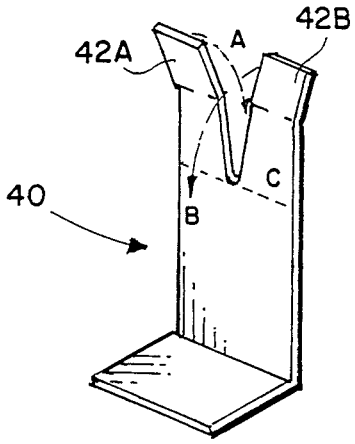
FIG. 10 is a perspective view of a fastening cleat in accordance with the invention.
Figure 9:
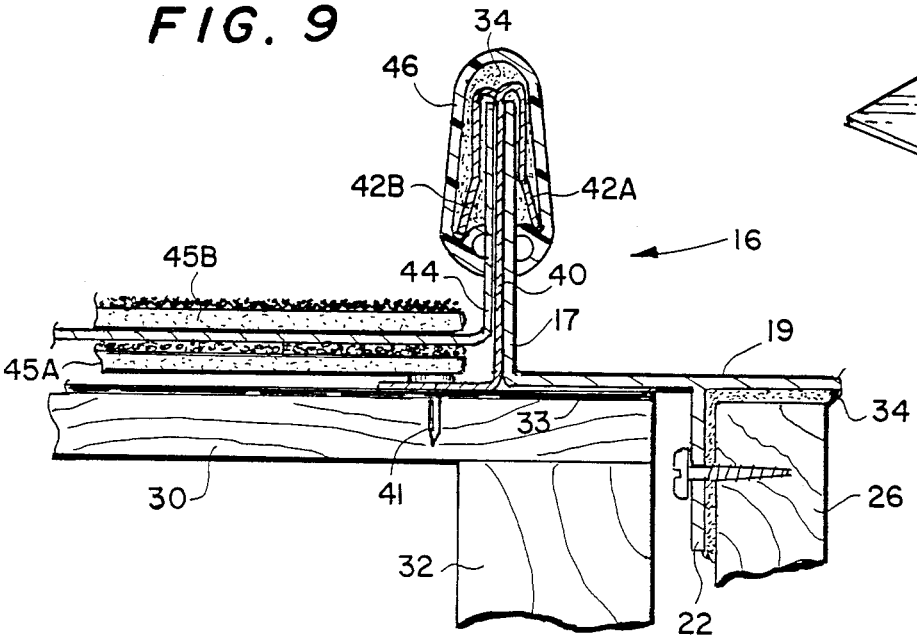
FIG. 9 is a cross-sectional view of a completed standing seam of the skylight of FIG. 4 when installed in a roof.

Turning now to FIG. 9, a lateral cross-sectional view of one side of an installed skylight is partially shown to illustrate the use of the standing seam to prevent water leakage along the longitudinal sides of the skylight. A plurality of fastening cleats 40, shown in perspective view in FIG. 10, is nailed or screwed to roof sheathing 30 with the vertical portion thereof in contact with standing seam element 17. Cleats 40 include a pair of tabs 42A, 42B having the extremities thereof bent outward slightly as shown. A first tab 42A is bent over the upper edge of standing seam element 17 along line C of FIG. 10 in the direction of arrow A. A step flashing 44 is disposed over a first shingle 45A and the second tab 42B of cleat 40 is folded over the upper edge of step flashing 44 in the direction of arrow B of FIG. 10. When the next row of shingles 45B is installed, shingle 45B overlaps step flashing 44, as will be more clearly shown in FIG. 11. After the step flashing 44 and shingles 45 have been completely installed, a snap-on plastic weather cap 46 is installed over the entire length of the standing seam element 17 and step flashings 44. The weather cap 46 snaps over the outwardly bent ends of tabs 42A and 42B. The resilience of plastic weather cap 46 forms a seal along standing seam 17 and step flashings 44. Weather cap 34 is preferably supplied with sealant 34 injected along its entire length to further insure a weathertight seam.

Figure 11:
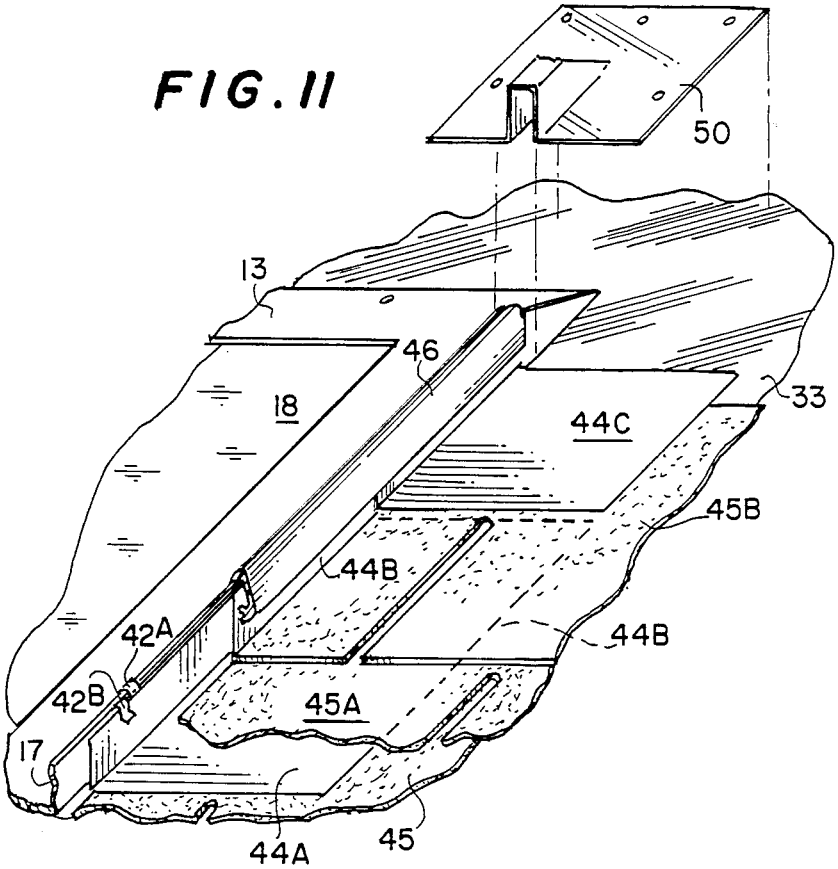
FIG. 11 is a perspective view of a part of the skylight of FIG. 4 installed in a sloping shingled roof having portions thereof cut away to illustrate the overlapping of the step flashing.

Additional details of the step flashing and standing seam installation are shown in FIG. 11 in which portions of shingles 45A and weather cap 46 have been cut away. Standing seam element 17 may be seen with clip 42A folded over the upper edge thereof. In FIG. 11, shingles have been installed through row 45B. Step flashing 44A has its horizontal portion installed over shingle 45 with its vertical portion held in contact with standing seam element 17 by clip 42B. Shingle 45A has been installed over the horizontal portion of step flashing 44A. The horizontal portion of step flashing 44B overlaps the upper portion of shingle 45A as seen in phantom view. The horizontal portion of step flashing 44C overlays the upper area of shingle 45B. After the next course of shingles is in place, shroud 50 is installed over the upper end of weather cap 46 and the remaining courses of shingles may then be laid. Weather cap 46 and shroud 50 are filled with sealant prior to installing. It is to be understood that the course of shingles along head flashing 13 will overlap that surface while sill flashing 14 (not shown in FIG. 11) will overlap the shingles at that lower end of the skylight. Beads of sealant are run across head flashing 13 before shingling.

As will now be recognized, the overlapping step flashings and shingles provide positive sealing in the roof plane without relying on sealants or the like, and the joints between the longitudinal sides or edges of the skylight are raised above the plane of the roof, such that the seam is easily sealed against water intrusion.

The skylight of the invention is now seen to comprise only four basic elements: a rigid mounting frame formed from two extrusions; a glass pane; a low cost wood glass retaining frame; and a set of step flashings. The invention permits an essentially leakproof installation in a sloping roof by virtue of the flashing-frame seam being raised above the roof plane yet maintaining a low profile.

Figure 12:
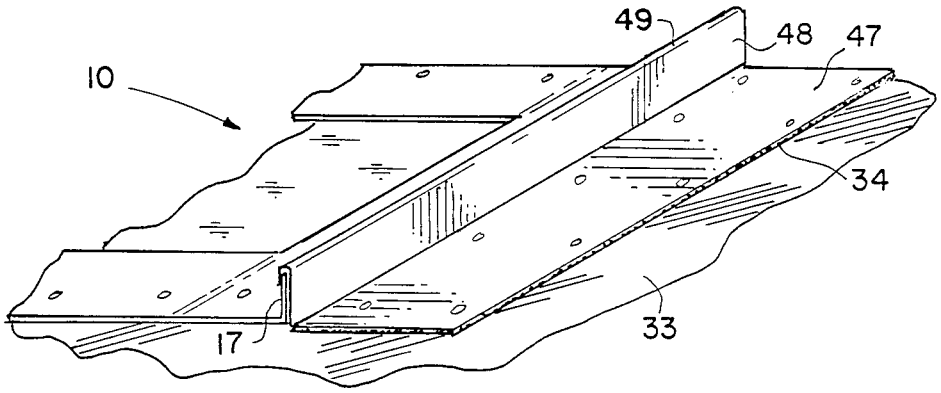
FIG. 12 is a perspective view of the glass skylight of the invention used with a single piece flashing.

Although the above described step flashing installation of the skylight of the invention is preferred, a simplified installation may be accomplished, as shown in FIG. 12, by using a single piece flashing along each standing seam. The flashing includes a horizontal portion 47 nailed to the roof decking over roofing felt 33 with a coating of sealant 34 therebetween. A vertical portion 48 includes a folded over edge 49 which is fitted over the standing seam 17 of skylight 10. A weather cap 46 and shroud 50 as shown in FIG. 11 is installed over the standing seam 17 and flashing portion 48 after installation of skylight 10.

Although specific implementations of the invention have been disclosed, it is to be understood that such disclosure is for exemplary purposes only and that various modifications may be made without departing from the spirit and scope of the invention.

We claim:

1. A low profile standing seam glass-type skylight for use with step flashing elements installed along roof sheathing, said skylight for installation over an opening in said roof sheathing, comprising:

a first rectangular frame having a planar flashing element including a rectangular opening therethrough;

an upstanding seam element along each longitudinal edge of said first frame for mating with said step flashing elements;

a rectangular recess formed by longitudinal and lateral webs depending form said planar flashing element;

a second frame having a rabbet around an interior periphery thereof disposed within said rectangular recess; and a glass plane disposed in said recess between said rabbet and said planar flashing element.

2. The skylight as recited in claim 1 in which said first rectangular frame includes:

a pair of longitudinal portions, each formed by an extrusion having said upstanding seam element and said longitudinal depending webs;

a pair of lateral portions, each formed by an extrusion having said lateral depending web; and said longitudinal and lateral portions joined to form said planar flashing element.

3. The skylight as recited in claim 1 which further comprises:

said plurality of step flashings;

a plurality of cleats for fastening to a roof sheathing and for engaging said upstanding seam element and said step flashings; and a weather cap for installing over a standing seam formed by said step flashings and said upstanding seam elements.

4. A skylight for use with step flashing elements installed on roof sheathing comprising:

(a) a first rectangular frame having (i) a pair of longitudinal flashing each having a vertically oriented standing seam element for mating with said step flashing elements and a depending web, (ii) a lateral head flashing having a depending web, (iii) a lateral sill flashing having a depending web, (iv) said depending webs joined to form a recess;

(b) a second frame having a rabbet around an interior periphery thereof and adapted to fit within said rectangular recess;

(c) a glass pane selected to fit within said rectangular recess and disposed within said recess between said rabbet and said first frame; and (d) sealant means for forming seals between edges of said pane and said and said recess, and said second frame.

5. The skylight as recited in claim 4 in which:

said longitudinal flashings are formed from a first extrusion; and said lateral flashings are formed from a second extrusion.

6. The skylight as recited in claim 5 in which first and second extrusions are of aluminum.

7. The skylight as recited in claim 4 in which said glass pane is formed from two glass sheets having an insulating air space therebetween.

8. A glass skylight installation for a pitched shingled roof having roof sheathing with a first rectangular opening therethrough, said opening having a pair of sloping edges, an upper horizontal edge, and a lower horizontal edge comprising:

(a) a first rectangular skylight frame having a planar flashing element, said element having an upper and a lower surface thereof and a second rectangular opening therethrough;

(b) an upstanding seam element along each longitudinal edge of said first frame forming a pair of parallel standing seam edges;

(c) a rectangular recess formed around said rectangular opening by longitudinal and lateral webs depending from said lower surface of said flashing element;

(d) a second frame disposed within said rectangular recess;

(e) a glass pane disposed in said recess and between said second frame and said lower surface of said flashing element;

(f) a first pair of parallel edges of said first frame having upward extending elements therealong thereby producing a pair of standing seam edges;

(g) a second pair of parallel edges of said first frame forming a head flashing and a sill flashing;

(h) said first skylight frame being disposed over and covering said first opening with said standing seam edges disposed along said pair of sloping edges of said first opening and a first lateral portion of said flashing element disposed along said upper horizontal edge of said first opening and attached to said roof sheathing and a second lateral portion of said flashing element disposed along said lower horizontal edge of said first opening and attached to said roof sheathing over a row of said roof shingles;

(i) means for anchoring said standing seam edges of said first skylight frame along the sloping edges of said roof sheathing adjacent said first opening;

(j) step flashing means attached to said roof sheathing and having vertical portions thereof abutting with each of said standing seam edges of said first skylight frame, said anchoring means attached to said vertical portions of said step flashing means and to said skylight standing seam edges, said vertical portions and said standing seam edges thereby forming a pair of standing seams; and (k) means for sealing each of said standing seams thereby formed.

9. The skylight installation as recited in claim 8 in which said anchoring means includes a plurality of anchor clips attached to said roof sheathing.

10. The skylight installation as recited in claim 8 in which said step flashing means includes a plurality of overlapping step flashings, each having a horizontal portion thereof attached to said sheathing and a vertical portion thereof abutting with said standing seam edges of said first skylight frame.

11. The skylight installation as recited in claim 10 which further comprises:

a vertical row of overlapping roof shingles disposed along each of said standing seams interleaved with and covering said horizontal portions of said step flashings; and a horizontal row of overlapping roof shingles disposed along and covering said first lateral portion of said flashing element.

12. The skylight as recited in claim 11 in which the corner of an upper end of each of said standing seams is cut off at an angle and which further comprises a shroud formed to match said cutoff ends, said shroud disposed over said cutoff ends and attached to said roof sheathing prior to disposition of said roof shingles over said flat flange.

13. The skylight installation as recited in claim 8 in which said means for sealing includes a batten disposed over said standing seams.

14. The skylight installation as recited in claim 13 in which said batten is filled with a sealing compound.

15. The skylight as recited in claim 8 in which said flashing means includes a pair of unitary flashing elements having a horizontal portion fastened to said roof sheathing, a vertical portion having a folded over upper edge fitted over said standing seam, and sealant between said horizontal portion and said roof sheathing.

16. A low profile skylight assembly for installation in a pitched roof, said assembly comprising:

(a) a roof engaging frame which include:

(i) a pair of side members, each having a roof-engaging flashing-like web, an inner edge and an outer edge, a first surface and a second surface, an upstanding flange-like standing seam element along said outer edge from said first surface, and a depending frame forming flange positioned between said inner and outer edges extending from the second surface;

(ii) a pair of lateral members, each having a roof-engaging flashing-like web, an inner edge and an outer edge, a first surface and a second surface, and a depending frame-forming flange positioned between said inner and outer edges on said second surface;

(iii) said side members and lateral members joined to form a generally rectangular outer frame;

(iv) said depending frame forming flanges joined to form a depending frame; and (v) said inner edges defining a frame opening;

(b) pane means larger than said frame opening positioned adjacent each of said flashing-like webs and within said depending frame forming webs so as to close said opening; and retaining means for cooperation with said depending frame and said pane means for engagement therewith and for retaining said pane means in said depending frame adjacent said flashing-like webs.

17. A skylight as defined in claim 16 wherein said retaining means comprises a wooden frame having outer edges adapted to fit within said depending frame and adapted to be secured thereto, said pane means comprising glass pane means, and said retaining means adapted to engage said pane means to secure said pane means in said frame and between said flashing-like web and said retaining means.

18. A skylight as defined in claim 17 wherein there is further provided means defining a condensate drip-receiving channel positioned adjacent one end of said pane between said pane and said retainer means for receiving condensate dripping from said pane.

19. A skylight as defined in claim 17 wherein said retaining means includes means defining a rabbet about the inner periphery of said retainer frame means for receiving and holding said pane means.

20. A skylight as defined in claim 16 wherein the exterior dimensions of said depending frame are selected to be less than the corresponding dimensions of a roof opening.

21. A skylight as defined in claim 20 wherein said retaining frame defines an opening having dimensions less than the corresponding dimensions of the depending frame and less than the roof opening to which the skylight is to be fitted.

22. A skylight as defined in claim 16 wherein each of said upstanding flange-like standing seam elements is inwardly offset at an end so that the spacing between standing seam elements is smaller at said one end than at the other end.

23. A skylight as defined in claim 16 and in combination therewith, a roof having a rectangular skylight receiving opening, said roof including sheathing upon which said flashing-like web rests, roofing felt on the roof sheathing, shingle means secured to roof sheathing and felt, step flashing having a base and an upstanding leg, said base secured to said shingle means and upstanding leg abutting said upstanding flange-like standing seam element, anchor-like means constructed to engage and retain the step-like flashing and standing seam element together to form a longitudinal seam, second shingle means for covering said step flashing base, and sealing means constructed to sealingly engage and surround said standing seam element and said abutting step-like flashing.

24. In a low profile skylight for use in a pitched roof, said skylight having a planar section to transmit exterior visible radiation to a building interior, radiation transmissive member, mounting means for carrying the radiation transmissive member, and constructed for mounting to a roof, and sealing means for cooperation with said mounting means and said roof for minimizing the passage of exterior elements through said skylight, said sealing means including step flashing means, the improvement comprising:

said radiation transmissive member being planar and adapted to transmit visible light therethrough;

said mounting means including frame means, which define a plane, for carrying said light transmissive member in a substantially coplanar relationship with said frame means;

said mounting means constructed to engage a roof so that said light transmissive member, mounting frame means and roof plane are all substantially coplanar; and said frame means including a pair of generally elongated upstanding seam members, each unitary with one of two opposed side edges of said frame means and constructed to mate with said step flashing means.

25. A skylight as in claim 24, wherein said planar light transmissive member is at least one pane of glass.

26. A skylight as in claim 25, wherein said light transmissive member is an insulated glass assembly having a pair of spaced but sealed glass panes.

27. A skylight as in claim 24, wherein said frame means defines an elongated four-sided shape and each of said upstanding standing seam members is unitary with and along the long sides of said frame, said standing seam members are essentially parallel to each other and are constructed to extend upwardly from said roof.

* * * * *